US009596917B2

(12) United States Patent
Lim

(10) Patent No.: US 9,596,917 B2
(45) Date of Patent: Mar. 21, 2017

(54) COSMETIC CONTAINER WITH PULVERIZING APPARATUS FOR GRANULATED COSMETIC

(71) Applicant: Toly Korea, Inc., Gyeonggi-do (KR)

(72) Inventor: Jun-Kuk Lim, Gyeonggi-do (KR)

(73) Assignee: TOLY KOREA INC., Kyunggi-Do (KR)

( * ) Notice: Subject to any disclaimer, the term of this patent is extended or adjusted under 35 U.S.C. 154(b) by 0 days.

(21) Appl. No.: 14/485,492

(22) Filed: Sep. 12, 2014

(65) Prior Publication Data

US 2015/0144662 A1 May 28, 2015

(30) Foreign Application Priority Data

Nov. 22, 2013 (KR) ..... 20-2013-0009637 U
Jan. 3, 2014 (KR) ..... 20-2014-0000028 U

(51) Int. Cl.
*B65D 88/54* (2006.01)
*A45D 33/02* (2006.01)
(Continued)

(52) U.S. Cl.
CPC ..... *A45D 33/02* (2013.01); *A45D 19/02* (2013.01); *A45D 34/00* (2013.01); *A45D 40/24* (2013.01);
(Continued)

(58) Field of Classification Search
CPC .... A61K 9/0019; A61K 9/122; B05B 7/0037; B05B 11/0083; B05B 11/3023;
(Continued)

(56) References Cited

U.S. PATENT DOCUMENTS 3,622,049 A * 11/1971 Thompson ..... 222/190
4,035,303 A * 7/1977 Ufferfilge ..... B65D 83/754 210/316
(Continued)

FOREIGN PATENT DOCUMENTS

KR 20-0180852 3/2000

OTHER PUBLICATIONS

Guerlain Meteorites Peries (2 pp.)(Jun. 17, 2012) https://fleuris-sante.wordpress.com/2012/06/17/guerlain-meteorites-perles-light-diffusing-perfecting-primer-review/.
(Continued)

*Primary Examiner* — Paul R Durand
*Assistant Examiner* — Charles P Cheyney
(74) *Attorney, Agent, or Firm* — Wissing Miller LLP

(57) ABSTRACT

A cosmetic container having a storage container for housing a liquid- or gel-form basic cosmetic and a granulated cosmetic having a different function from the basic cosmetic, an airless pump on top of the storage container for discharging the mixed cosmetics from the storage container, and pulverization apparatus including a pulverizing member, a first pulverizing mesh and a second, finely pulverizing mesh positioned in a plurality of stages in a discharge pathway within the airless pump to cause the granulated cosmetic in the mixed cosmetics to be finely pulverized in a plurality of stages, with multistage smashing and fine pulverization of the granulated cosmetic in the pump such that discharge of the cosmetic is thereby performed smoothly when the cosmetic is used.

4 Claims, 7 Drawing Sheets

(51) Int. Cl.

| | |
|---|---|
| ***A45D 19/02*** | (2006.01) |
| ***B05B 11/00*** | (2006.01) |
| ***A45D 34/00*** | (2006.01) |
| ***A45D 40/24*** | (2006.01) |
| ***B02C 19/00*** | (2006.01) |
| ***B01F 5/06*** | (2006.01) |
| *B05B 7/14* | (2006.01) |

(52) U.S. Cl.

CPC ..... *B01F 5/0693* (2013.01); *B02C 19/0056* (2013.01); *B05B 11/0083* (2013.01); *B05B 11/3023* (2013.01); *B05B 11/3042* (2013.01); *B05B 11/3067* (2013.01); *A45D 2200/054* (2013.01); *A45D 2200/056* (2013.01); *A45D 2200/057* (2013.01); *A45D 2200/058* (2013.01); *B05B 7/14* (2013.01); *B05B 11/3004* (2013.01); *B05B 11/3047* (2013.01); *B05B 11/3066* (2013.01); *B05B 11/3074* (2013.01)

(58) Field of Classification Search

CPC ..... B05B 11/3042; B05B 11/3067; B05B 11/3004; B05B 11/3047; B05B 11/3066; B05B 11/3074; A45D 2200/054; A45D 2200/056; A45D 2200/057; A45D 2200/058; B02C 19/0056; B01F 5/0693

USPC ..... 222/190, 211, 256, 321.9, 326, 429, 222/189.02, 189.04; 401/200

See application file for complete search history.

(56) References Cited

U.S. PATENT DOCUMENTS

| | | | | |
|---|---|---|---|---|
| 5,037,006 | A * | 8/1991 | Kock | 222/190 |
| 5,048,750 | A * | 9/1991 | Tobler | 222/190 |
| 5,064,103 | A * | 11/1991 | Bennett | 222/190 |
| 5,071,379 | A * | 12/1991 | Poizot | 222/190 |
| 5,284,275 | A * | 2/1994 | Shomer | B01F 5/0683 206/219 |
| 6,352,182 | B1 * | 3/2002 | Gueret | 222/321.9 |
| 6,572,873 | B1 * | 6/2003 | Osman et al. | 424/423 |
| 8,631,975 | B2 | 1/2014 | Lim | |
| 2009/0283545 | A1 * | 11/2009 | Kimball | B05B 11/0059 222/189.06 |
| 2011/0056993 | A1 * | 3/2011 | Lee et al. | 222/256 |
| 2012/0279993 | A1 * | 11/2012 | Lott et al. | 222/189.02 |
| 2015/0209810 | A1 * | 7/2015 | Bibette | B01F 5/0694 222/1 |

OTHER PUBLICATIONS

Stella Lee Review: Guerlain Meteorites Perles Light . . . (3 pp.)(Feb. 15, 2013) www.stellalee.net/2013/02/review-guerlain-meteorites-perles-light.html.

Temptalia Guerlain Meteorites Light-Diffusing . . . (2 pp.)(Aug. 26, 2013) www.temptalia.com/guerlain-meteorites-light-diffusing-perfecting-primer-review-photos-swatch.

* cited by examiner

COSMETIC CONTAINER WITH PULVERIZING APPARATUS FOR GRANULATED COSMETIC

BACKGROUND OF THE INVENTION

This invention relates to a cosmetic container including pulverizing apparatus for a granulated cosmetic housed therein, and more particularly to a cosmetic container having pulverizing apparatus wherein during use of the cosmetic, the cosmetic discharge efficacy is improved by the provision of a pulverization structure that smashes and finely pulverizes, in a plurality of stages, a granulated cosmetic in a cosmetic mixture being discharged in an airless pump of a cosmetic container housing a mixture of a liquid- or gel-form basic cosmetic and a granulated cosmetic having a different function.

Substances that may be contained in and dispensed by containers of the present invention include, without limitation, small and generally spheroidal bodies of material, immersed in a liquid or gel continuous phase (vehicle), that are individually coherent and stably self-sustaining in shape while quiescently thus immersed but are adapted and intended to be broken up (e.g., comminuted, smashed, pulverized or disintegrated) into smaller bits dispersed in the vehicle incident to being discharged therewith from a container for application or other use. Commonly or typically, they are solid or semi-solid, more or less round, a few (e.g., about three) millimeters in size, and may be solid or semi-solid, may be soft and may swell to some extent while immersed in the vehicle. Materials currently commercially available as such bodies include a variety of cosmetics, some having a pearlescent appearance. Bodies of this type are referred to by diverse terms, including granules, pellets, and beads, or are characterized as having a granular or capsular form. For convenience, all such bodies will be designated "granulated cosmetics" herein, but the invention in its broader aspects includes containers for granules, pellets or beads of other materials as well, including (again without limitation) products for personal care such as hair care and oral care), and the term "granulated cosmetics" is to be understood as embracing generally small bodies of material (regardless of end use) in self-sustaining granular or capsular form as quiescently immersed in a liquid or gel vehicle but adapted and intended to be broken up into smaller (typically much smaller) pieces or fragments and dispersed in the vehicle during discharge from a container. Again for convenience, all such breaking up of granulated cosmetics into smaller bits will be designated herein by the term "pulverize" in its various forms ("pulverization," "pulverizing," etc.).

Generally, when make-up is applied, the make-up is used by selecting from a large number of cosmetics having various functions and forms depending on the preference or skin type of the user, and these cosmetics are constructed in various forms such as for example liquids, powders, gels, solids etc.

Moreover, recently, accompanying further diversification in cosmetic functionality, cosmetics have become widely used in a form wherein there are housed mixed cosmetics obtained by mixing a cosmetic comprising small granules having a pearlescent function with a liquid- or gel-form cosmetic.

Such granulated cosmetics have various colours and feels etc., or unique functions that differ from basic cosmetics, and when used are suitably mixed with liquid- or gel-form basic cosmetics.

In particular, granular pearlescent cosmetics have excellent characteristics in terms of visual attractiveness when shipped in a form wherein they are housed in a transparent cosmetic container, and accordingly have shown a gradual tendency towards increased use, and application can be readily made when used, because by finely pulverizing using the pumping power of an airless pump provided on the cosmetic container, discharge may be made in the form of admixture together with a basic liquid- or gel-form cosmetic.

As far as the construction of the cosmetic container in which such granular cosmetics are housed is concerned, in the same way as in the containers known from the prior art, the construction is of a container such that there is admixture together with the liquid- or gel-form basic cosmetic, and a pump connected to the top of the container, such that the contents in the container are discharged to the outside in a fixed amount by the pumping power afforded by causing a pushing action.

Accordingly, during use, when the operating button of the pump is subject to a pushing operation, the cosmetic housed as a mixture in the container is discharged along a discharge path and through a nozzle to the outside in response to the operation of the pump.

In this case, due to the discharge of the liquid- or gel-form basic cosmetic along the discharge pathway, the granulated-form cosmetic is also caused to be discharged together with the basic cosmetic, and because it is in the form of solid granules, while colliding with a plurality of members in the discharge path, it is caused to have a greatly reduced size, and discharge is made in the form of a mixed cosmetic. The mixed cosmetic discharged in this way has an extremely fine size when applied onto the skin, thus providing a unique performance.

On the other hand, when considering the mechanical construction of cosmetic containers housing such granular cosmetics, for example, although not a specific cosmetic container, there is a construction known from the prior art wherein a special mesh body having fine holes is provided in the discharge pathway of a cosmetic container together with an airless pump.

Accordingly, the construction is such that if the granulated cosmetic which is discharged together with the liquid- or gel-form basic cosmetic is of a pulverized fine size smaller than the hole size of the mesh body, then the granulated cosmetic is discharged; while on the other hand, if the granulated cosmetic is of a size larger than the hole size, the granulated cosmetic is not discharged and becomes trapped on the sieve.

However, with such a construction of the prior art, the holes of the mesh body are readily blocked, and when the holes of the mesh body become blocked, the pump cannot operate smoothly due to the internal pressures applied within the pump, and this presents a serious problem.

SUMMARY OF THE INVENTION

An object of the present invention, taking into account the aforementioned problems of the prior art, is to provide a pulverizing apparatus for a granulated cosmetic housed in a cosmetic container, of the kind wherein there is housed therein an admixture of a granulated-form cosmetic with a liquid- or gel-form basic cosmetic, wherein due to the operation of a pump, the discharge of the mixed cosmetic is readily performed in a plurality of stages such that the pulverization of the granulated cosmetic being discharged is readily achieved.

To these and other ends, the invention broadly contemplates the provision of a cosmetic container having an airless pump and including a discharge pathway wherein are disposed, in a plurality of stages and in a manner such that there are mutual spaces therebetween, a pulverizing member having a plurality of large holes through which a first pulverization can be caused while the granulated cosmetic passes therethrough, a pulverizing mesh for subjecting the granulated cosmetics which have passed through said pulverizing member to a second pulverization to a yet smaller size, and a finely pulverizing mesh for subjecting the cosmetic which has passed through the first and second pulverizations to a third pulverization to a fine size.

As a result of the presence of a structure wherein the granulated cosmetics can be pulverized in a plurality of stages in the pump of a cosmetic container which houses an admixture of a liquid- or gel-form basic cosmetic with a granulated cosmetic having another function, the present device has the effect of remarkably improving the pulverizing efficiency for granulated cosmetics which are discharged during use.

In other words, while enabling use of a mixed cosmetic comprising a mixture of a granulated cosmetic and a liquid- or gel-form cosmetic, due to a first, second and third multi-staged pulverization being adopted for the pulverization of the granulated cosmetic discharged when the pump of the cosmetic container is operated, the effect obtained is one wherein not only are blockages not generated in the discharge pathway, but there is no generation of abnormalities such as elevated internal pressures of the pump.

Further features and advantages of the invention will be apparent from the detailed description hereinbelow set forth, together with the accompanying drawings.

DETAILED DESCRIPTION

Figure 1:
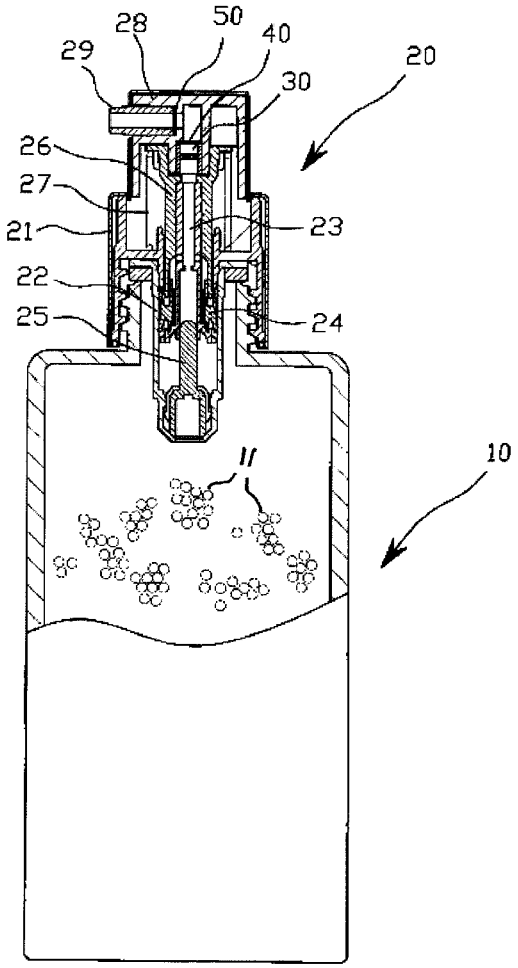
FIG. 1 is an elevational view, partly in section, of a cosmetic container embodying the present invention in a particular form.

As shown in FIG. 1, the device of the invention in its illustrated embodiment includes a storage container 10 in which are housed cosmetics, and an airless pump 20 for pumping the cosmetics inside the container to the outside, and which is fitted on the opening of the storage container 10.

The storage container 10 houses a mixture of granulated cosmetic and liquid- or gel-form basic cosmetic in the interior thereof, wherein the granulated cosmetic and the basic cosmetic have a different function from each other and are applied, with mixing together, to form a mixed cosmetic occurring during the process of discharge. In the device shown, the storage container 10 is composed of a transparent body, so that when not in use, the granulated cosmetic (represented in FIG. 1 by multiple discrete generally spheroidal bodies 11) can be seen to be floating in the basic cosmetic inside the storage container 10, and visual appeal is demonstrated.

Figure 2:
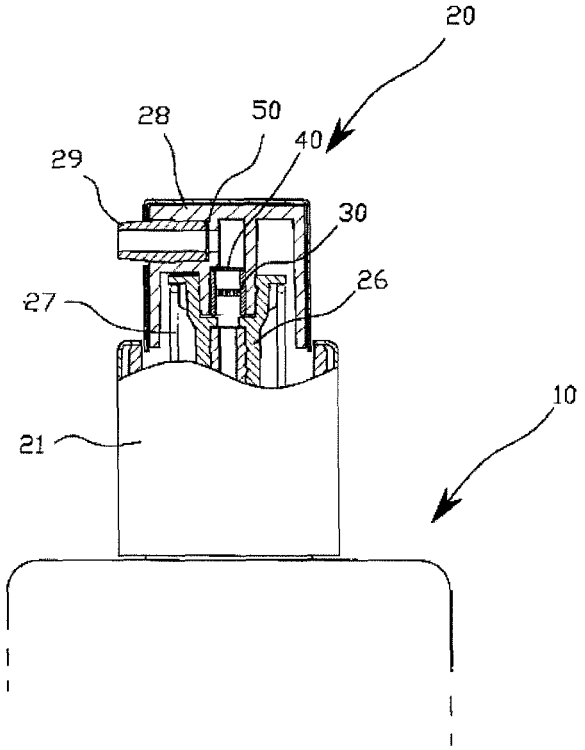
FIG. 2 is an enlarged fragmentary elevational view, partly in section, showing the airless pump portion and pulverizing apparatus of the container of FIG. 1.
Figure 3:
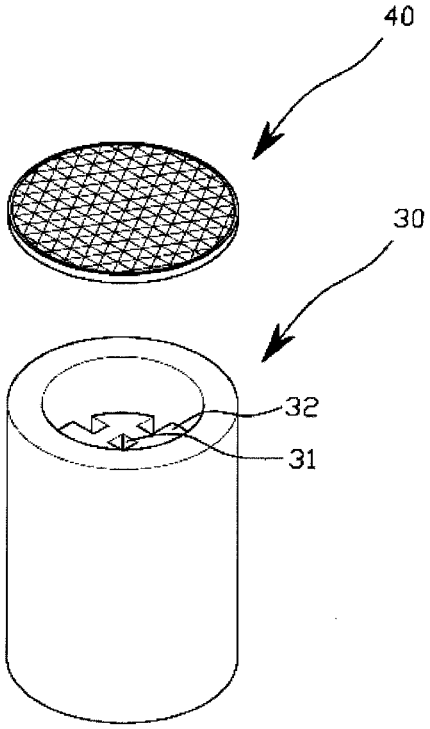
FIG. 3 is a further enlarged exploded perspective view of the pulverizing member and associated first pulverizing mesh in the container of FIGS. 1-2.
Figure 4:
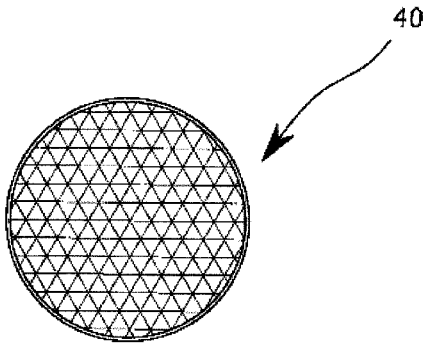
FIG. 4 is a plan view of the first pulverizing mesh of FIG. 3.
Figure 5:
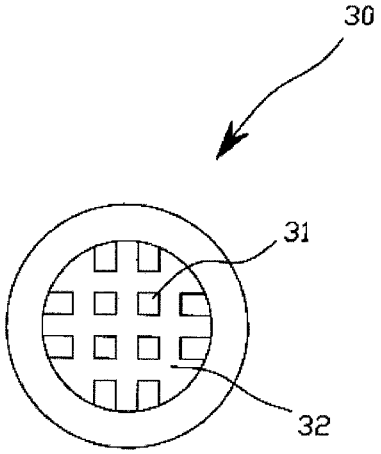
FIG. 5 is a plan view of the pulverizing member of FIG. 3.
Figure 6:
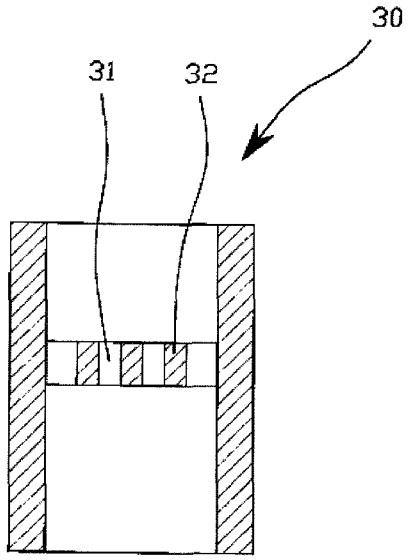
FIG. 6 is an elevational sectional view of the pulverizing member of FIGS. 3 and 5.
Figure 7:
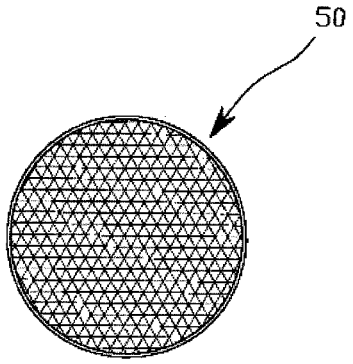
FIG. 7 is an elevational view of the second, finely pulverizing mesh of the container of FIGS. 1-2.

The airless pump 20, as seen in FIG. 2, is equipped with and constructed of an airtight cap 21 thread fastened onto the opening of the storage container 10; within this airtight cap 21 is fastened a compression cylinder 22; and inside the compression cylinder 22, a piston 23, piston valve 24 and on-off valve 25 are fastened which move up and down together with the piston 23.

The compression cylinder 22 is of cylindrical form, and the upper flange is fastened in a state such that the inlet of the storage container 10 is tightly sealed, and moreover a compression chamber is formed inside thereof, and also at the bottom, a flow-through path is formed which connects to the storage container 10 and via which the contents are introduced into the compression chamber, and this flow-through path has a construction whereby it may be opened or closed by the on-off valve 25.

Moreover, on the piston 23 is flexibly installed an actuating tube 26 in compliance with a spring 27 which operates the piston 23 and the piston valve 24 in an accordant up-and-down motion. Moreover, an operating button 28 which is exposed on the outside, is fastened on top of the actuating tube 26, and a nozzle 29 is established on the operating button 28 which, while communicating with the interior, finally discharges the contents discharged from the storage container 10 to the outside.

The airless pump 20 has a similar construction to technology heretofore proposed by applicants; however, in the present device, the airless pump is constructed and fitted with a pulverizing apparatus such that while the granulated cosmetic is being discharged along the pathway along which the contents from the airless pump 20 are discharged, first, second and third pulverizations are caused.

As illustrated in detail in the drawings, the pulverizing apparatus has a construction such that during the process whereby the granulated cosmetic is discharged, in addition to that by the various members, it is also pulverized in a plurality of stages, wherein in the drawings, 30 denotes a pulverizing member for a first pulverization, 40 denotes a first pulverizing mesh for a second pulverization and 50 denotes a second, finely pulverizing mesh for a third fine pulverization.

The pulverizing member 30 is formed into a cylindrical form by the injection molding of synthetic resin material, and is fixed by closely inserting and fastening on the discharge pathway at a position to which the operating button 28 and actuating tube 26 are connected. Inside the pulverizing member is transversely provided a partition 32 perforated by a plurality of through-holes 31 having a quadrilateral shape.

Although in the illustrated embodiment the through-holes 31 which perforate said partition 32 are formed with a quadrilateral shape, the through-holes may have a different polygonal shape or a circular shape.

Moreover, the first pulverizing mesh 40 is established so as to be closely attached to the pulverizing member 30, is formed from a mesh woven in synthetic resin or a metallic material, and is constructed so that the granules that have been firstly pulverized to a smashed state by the pulverizing member 30 can be pulverized again by abrasion. Accordingly, the holes of the pulverizing mesh 40 are subject to the condition that they must be at least smaller in size than the the through-holes 31 of the pulverizing member 30.

Furthermore, the second, finely pulverizing mesh 50, which is established behind the nozzle 29 and is formed from synthetic resin, metal or the like (and may be formed as a mesh of various shapes), is constructed so that the granulated cosmetics which have a small size and have been pulverized further by the secondary pulverization of the first pulverizing mesh 40, can be further finely pulverized by abrasion as they continue their passage.

The holes of the finely pulverizing mesh 50 are preferably at least smaller than those of the pulverizing mesh 40, and moreover, the finely pulverizing mesh 50, rather than being a mesh as shown, may be a plate which has been injection moulded from synthetic resin material and perforated with a plurality of small sized holes.

On the other hand, the pulverizing member 30, first pulverizing mesh 40 and finely pulverizing mesh 50 of the pulverizing apparatus may be expected to develop the same effect for example, by installation in line in suitable positions along the discharge pathway for the contents which are to be discharged from the storage container 10.

Moreover, although illustrations thereof are not shown in the Figures, the first pulverizing mesh 40 and finely pulverizing mesh 50 can be injection moulded from synthetic resin material or be mesh-constructed in a variety of shapes by using materials such as combinations of fibres and synthetic resin etc.

The present device with the above construction is generally used during installation in a pump of a cosmetic container in which a granulated cosmetic and a liquid- or gel-form basic cosmetic are mixed.

In the operation of the described embodiment of the invention, when the operating button 28 is pushed, the actuating tube 26 is depressed while compressing the spring 27 in accordance with the pushing action, and thereby the piston 23 and the piston valve 24 while being depressed cause the compression of the compression chamber within the compression cylinder 22.

In other words, due to the downwards motion of the actuating tube 26, the piston 23 is firstly lowered, opening the gap with the piston valve 24, and by such movement, the contents filled in the compression chamber are discharged along the gap between the piston 23 and the piston valve 24, and discharged via an orifice perforated in the centre of the piston 23 through the interior thereof.

Subsequently, due to the downwards motion of the actuating tube 26, the piston valve 24 undergoes a downward motion, the compression chamber is strongly compressed, and thereby the contents in the compression chamber are caused to flow via an orifice in the piston 23 into the interior thereof, and thereafter are discharged via the pulverizing member 30, pulverizing mesh 40 and fine pulverizing mesh 50 above, to the outside, via a nozzle 29. During this procedure, because of the descent of the piston 23, the on-off valve 25 in the compression chamber closes the flow through path at the bottom of the compression cylinder 22.

Accordingly, due to the operation of the pump, the mixed product in the storage container 10, namely, the mixed cosmetic comprising a mixture of the liquid- or gel-form basic cosmetic and the granulated cosmetic having a different function from the basic cosmetic, is discharged via the opened discharge pathway.

During this procedure, the granulated cosmetic in the mixed cosmetic discharged as above is smashed and pulverized by abrasion against each member along the discharge pathway, and this smashed granulated cosmetic is first pulverized to a suitable size by abrasion during its passage through the pulverizing member 30, and is discharged by passage through the plurality of through-holes 31.

Subsequently, the granulated cosmetic which has been subjected to a first pulverization by passage through the pulverizing member 30, while passing through a first pulverizing mesh 40 established so as to be in close attachment to the pulverizing member 30, is further finely pulverized by abrasion against the pulverizing mesh 40, which is composed of a mesh.

The mixed cosmetics which have been subjected to such first and second pulverizations, immediately prior to passing through the nozzle and while passing through a finely pulverizing mesh 50, are further pulverized to an extremely fine size by further abrasion, and are discharged to the outside via the nozzle 29.

Therefore, the phenomenon of discharge pathway blockage can be eliminated because in addition to pulverization by each member of the pump, the granulated cosmetics are also pulverized, in a plurality of stages, while passing successively through the pulverizing member 30, first pulverizing mesh 40 and second, finely pulverizing mesh 50. Moreover, due to uniform pulverization being caused, the granulated cosmetics are completely absorbed into the liquid- or gel-form basic cosmetic, and an effect may be manifested whereby uniform application to the skin is possible.

Conversely, when the push-operated operating button 28 is released, the operating button 28 returns to the original position due to the restoring force of spring 27, and in response to this, the actuating tube 26, piston valve 24 and piston 23 are conversely driven upwards to the original position.

Accordingly, all the discharge pathways which have been opened above the compression chamber are then closed, and together with this, the pressure in the compression chamber rises, the on-off valve 25 rises and the flow-through path opens, and thus the contents in the storage container 10 fill into the compression chamber. Repetitions of such movements mean that cosmetics mixed in the storage container 10 can be advantageously applied.

It is to be understood that the invention is not limited to the features and embodiments hereinabove specifically set forth, but may be carried out in other ways without departure from its spirit.

This application claims the priority benefit, under 35 U.S.C. §119(a), of Korea patent application No. 20-2013-0009637 filed Nov. 22, 2013, and Korea patent application No. 20-2014-0000028 filed Jan. 3, 2014; the disclosures of both of these Korea patent applications are incorporated herein in their entirety by this reference.

What is claimed is:

1. A cosmetic container having pulverization apparatus for a granulated cosmetic housed in the cosmetic container, comprising:

(a) a storage container for containing a mixed cosmetic comprising a mixture of a liquid-or gel-form basic cosmetic and a granulated cosmetic having a different function from the basic cosmetic and comprising small granules;

(b) an airless pump, with a pump cylinder and a discharge pathway leading therefrom to a nozzle, disposed on said storage container for discharging the mixed cosmetic in the storage container; and (c) pulverization apparatus disposed downstream from the pump cylinder for subjecting the granulated cosmetic to pulverization, such that the granulated cosmetic in the mixed cosmetic discharged from said pathway is absorbed into the liquid- or gel-form basic cosmetic for application to a user's skin, without generating blockage of said discharge pathway, said pulverization apparatus including a pulverizing member, a first pulverizing mesh and a second, finely pulverizing mesh, arranged in a plurality of successive stages in said discharge pathway, with spaces there between, such that the granulated cosmetic in the mixed cosmetics is caused to be finely pulverized over the plurality of stages, wherein the pulverizing member includes a partition perforated by a plurality of through-holes through which the granulated cosmetic can be caused to be passed while being pulverized into bits smaller than said granules, said first pulverizing mesh is a mesh for subjecting the granulated cosmetic which has passed through said pulverizing member to a second pulverization into bits smaller than the first-mentioned bits, and said second pulverizing mesh is a mesh for subjecting the granulated cosmetic which has passed through the first pulverizing mesh to a third pulverization into bits smaller than the second-mentioned bits; and wherein said first pulverizing mesh is a mesh including holes smaller than the size of the through holes of the pulverizing member and said second, finely pulverizing mesh has holes of a size smaller than the size of the holes of the first pulverizing mesh.

2. A cosmetic container as defined in claim 1, wherein the pulverizing member is cylindrical and includes said partition as an integral partition therein.

3. A cosmetic container as defined in claim 1, wherein said pulverizing member is constructed in the form of a mesh.

4. A cosmetic container having pulverization apparatus for a granulated cosmetic housed in the cosmetic container, comprising:

(a) a storage container containing a mixed cosmetic comprising a mixture of a liquid- or gel-form basic cosmetic and a granulated cosmetic having a different function from the basic cosmetic and comprising small granules;

(b) an airless pump, with a pump cylinder and a discharge pathway leading therefrom to a nozzle, disposed on said storage container for discharging the mixed cosmetic in the storage container; and (c) pulverization apparatus disposed downstream from the pump cylinder for subjecting the granulated cosmetic to pulverization, such that the granulated cosmetic in the mixed cosmetic discharged from said pathway is absorbed into the liquid- or gel-form basic cosmetic for application to a user's skin, without generating blockage of said discharge pathway, said pulverization apparatus including a pulverizing member, a first pulverizing mesh and a second, finely pulverizing mesh, arranged in a plurality of successive stages in said discharge pathway, with spaces there-between, such that the granulated cosmetic in the mixed cosmetics is caused to be finely pulverized over the plurality of stages, wherein the pulverizing member includes a partition perforated by a plurality of through-holes through which the granulated cosmetic can be caused to be passed while being pulverized into bits smaller than said granules, said first pulverizing mesh is a mesh for subjecting the granulated cosmetic which has passed through said pulverizing member to a second pulverization into bits smaller than the first-mentioned bits, and said second pulverizing mesh is a mesh for subjecting the granulated cosmetic which has passed through the first pulverizing mesh to a third pulverization into bits smaller than the second-mentioned bits; and wherein said first pulverizing mesh is a mesh including holes smaller than the size of the through-holes of the pulverizing member and said second, finely pulverizing mesh has holes of a size smaller than the size of the holes of the first pulverizing mesh.

* * * * *